United States Patent [19]

Asick et al.

[11] 4,106,836

[45] Aug. 15, 1978

[54] CRIMP BARREL FOR THICK, FLAT, FLEXIBLE CABLE

[75] Inventors: John Carl Asick, Harrisburg; Clifton Wesley Huffnagle, Camp Hill, both of Pa.

[73] Assignee: AMP Incorporated, Harrisburg, Pa.

[21] Appl. No.: 787,685

[22] Filed: Apr. 14, 1977

[51] Int. Cl.[2] ..... H01R 11/20
[52] U.S. Cl. ..... 339/97 C
[58] Field of Search ..... 339/97 C, 276

[56] References Cited

U.S. PATENT DOCUMENTS

| | | | |
|---|---|---|---|
| 2,783,447 | 2/1957 | Watts | 339/97 C |
| 3,077,027 | 2/1963 | Sola et al. | 339/97 C |
| 3,335,392 | 8/1967 | Elliott | 339/97 C |
| 3,963,857 | 6/1976 | Reynolds et al. | 339/97 C |

*Primary Examiner*—Joseph H. McGlynn
*Attorney, Agent, or Firm*—Russell J. Egan

[57] ABSTRACT

An improved crimp barrel is described for making an insulation piercing crimp connection with flat flexible cable having thick insulation surrounding a heavy conductor. The subject crimp barrel provides added strength for the insulation piercing portions so as to enable penetration of relatively thick insulation without collapsing.

6 Claims, 8 Drawing Figures

CRIMP BARREL FOR THICK, FLAT, FLEXIBLE CABLE

BACKGROUND OF THE INVENTION

The Field of the Invention

The present invention relates to an improved crimp barrel for making electrical and mechanical contact with heavy conductors surrounded by rather thick insulation.

The present invention represents an improvement over the type of crimpable connecting device disclosed in U.S. Pat. No. 3,395,381. While the crimp barrel disclosed in the noted patent has operated satisfactorily for a number of years, it has not always been suitable for use with all types of cable. In particular, there is some difficulty in the sidewalls not being able to withstand the forces necessary to penetrate the rather thick insulation layers which usually encase thick high current conductors.

The somewhat earlier improvement on the abovementioned U.S. patent appears in U.S. Pat. No. 3,713,072 which relates to a contact for providing a post receiving member on a flat flexible cable.

U.S. Pat. No. 3,960,430 discloses a flat wiring system connector which will make a crimp connection with the rather heavy conductors surrounded by a heavy layer of insulation used in under carpet wiring high current systems.

U.S. Pat. No. 3,197,729 discloses a connector which makes engagement with the conductor of a flat flexible cable by piercing partially through the cable in rivet fashion. There is no full crimping of the connector in this patent.

SUMMARY OF THE INVENTION

The present invention relates to an improved insulation piercing crimp connection for engaging electrical terminals with the conductors of multi-conductor flat flexible cable. Accordingly the subject crimp barrel comprises a web and a pair of parallel spaced sidewalls integral with and extending from opposite sides of the web to define a channel or U-shaped section. Each sidewall has at least one aperture therein adjacent the web and corresponding lances are formed integrally with the web. The lances are struck upwardly from the web to extend at least partially into the apertures in the sidewalls. The free ends of the sidewalls are profiled to aid in the pentration of insulation. In use the subject crimp barrel portion of a contact is positioned adjacent a flat conductor cable with the sidewalls of the crimp barrel straddling a conductor of the cable. The sidewalls are then forced through the insulation and curled inwardly upon themselves to again pierce the insulation and engage the conductor. The upstanding lances will also make an engagement with the conductor from the opposite side thereof to pinch the conductor therebetween.

It is therefore an object of the present invention to produce an improved crimp barrel which will effect crimp connection of terminals onto thick flat flexible cable.

It is a further object of the present invention to produce an improved crimp barrel which can be used in combination with an electrical contact having any type of matable porton.

It is a further object of the present invention to teach an improved crimp barrel for an electrical contact which can be readily and economically manufactured.

The means for accomplishing the foregoing objects and other advantages will become apparent to those skilled in the art from the following detailed description taken with reference to the accompanying drawings.

DESCRIPTION OF THE PREFERRED EMBODIMENT

Figure 1:
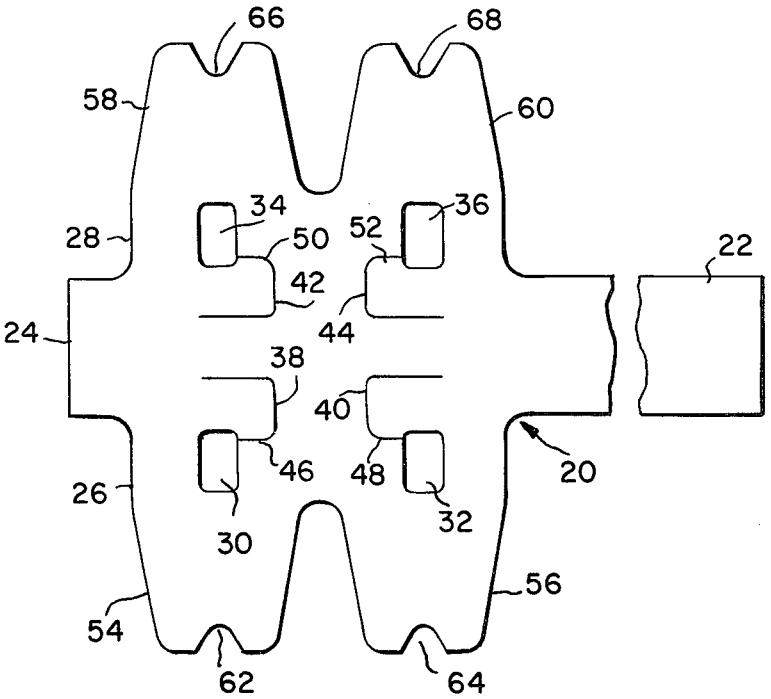
FIG. 1 is a plan view of the subject crimp barrel as it appears after being blanked from metal stock material.
Figure 2:
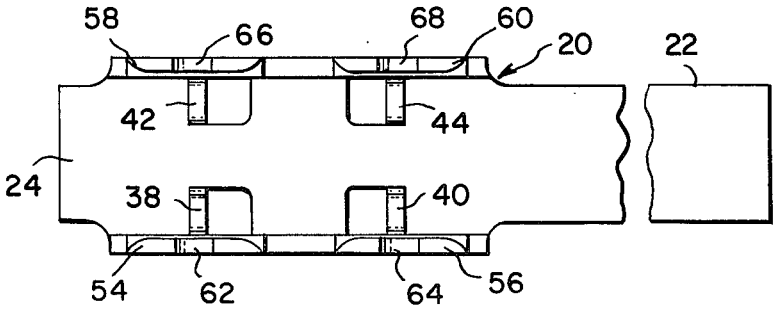
FIG. 2 is a top plan view of the subject crimp barrel after stamping and forming.
Figure 3:
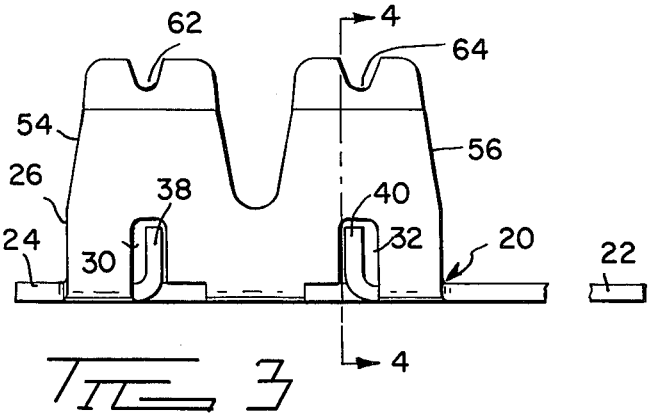
FIG. 3 is a side elevation of the subject crimp barrel of FIG. 2.
Figure 4:
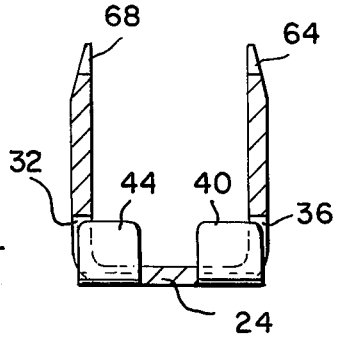
FIG. 4 is a transverse vertical section through the subject crimp barrel taken along line 4—4 of FIG. 3.
Figure 5:
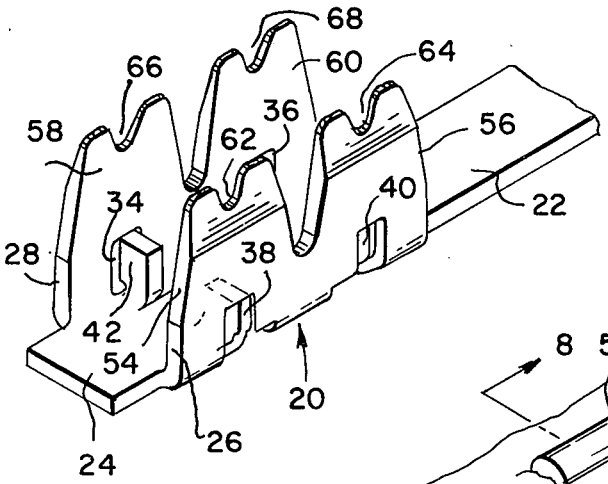
FIG. 5 is a perspective view of the subject crimp barrel shown in FIGS. 1 to 4.

The subject crimp barrel is intended for use in terminating flat flexible cable of the known type. The subject crimp barrel is particularly useful for cable having thick conductors and surrounded by thick layers of insulation. Such a cable is represented, in part, in FIGS. 6 to 8 with the cable 10 including a thick layer of insulation 12 surrounding a thick conductor 14. Typically thick cable of this type has ridges 16, 18 aligned with the longitudinal axis of the conductors and providing a rather rigid spine along the cable.

The subject crimp barrel 20 can be used with a matable portion of any known configuration to form an electrical contact. Only a schematic fragment 22 of such a matable portion has been illustrated.

The blank which forms the subject crimp barrel is shown in FIG. 1 and includes a web 24 and an integral pair of spaced sidewalls 26, 28. A plurality of apertures 30, 32, 34, 36 are formed in the sidewalls adjacent their juncture with the web. A like plurality of lances 38, 40, 42, 44 are formed in the web 24 each lance includes a respective projecting portion 46, 48, 50, 52. Each sidewall is profiled to define a plurality of tines 54, 56, 58, 60 and each tine has a slot 62, 64, 66, 68 formed in the free edge in substantial alignment with the respective lance.

The blank of FIG. 1 is stamped from any conventional material used for making electrical contacts. The sidewalls 26, 28 are bent to extend substantially normal to the web 24 and parallel to each other to form the channel configuration shown in FIGS. 2 to 5. The lances 38, 40, 42, 44 are struck upwardly to extend substantially normal from the web 24. In this position the projections 46, 48, 50, 52 extend into the respective apertures 30, 32, 34, 36 of the sidewalls. Thus the lances interlock the sidewalls and prevent the tines from collapsing when they are forced through thick insulation.

Figure 6:
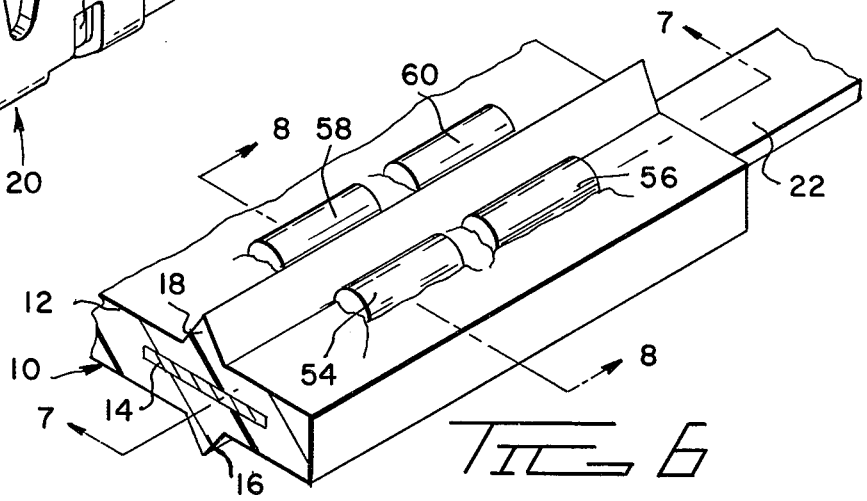
FIG. 6 shows the subject crimp barrel fully terminated on a thick flat flexible cable.
Figure 7:
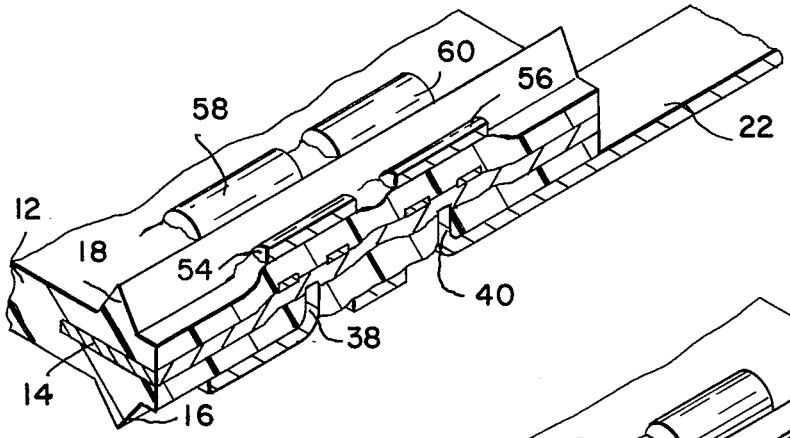
FIG. 7 is a vertical section taken along line 7—7 of FIG. 6.
Figure 8:
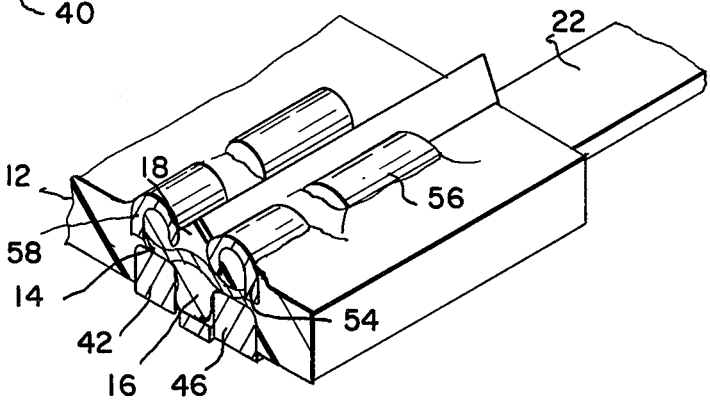
FIG. 8 is a transverse section taken along line 8—8 of FIG. 6.

Contacts including the subject wire barrel are crimped onto respective conductors, as shown in FIGS. 6 to 8, by forcing the tines in a first direction through insulation 12 with tines 54, 56, and 58, 60 lying on opposite sides of conductor 14. The free ends of the tines are then curled inwardly upon themselves to penetrate the insulation in the opposite direction. The slots 62, 64, 66, 68 of the tines are substantially centered over the respective lances 38, 40, 42, 44. The crimping force drives the lances into the insulation from the first direction. The slots in the tines allow the lances to distort the conductor from the bottom while the tines distort the conductor from the top. This puts a jog in the conductor which improves the electrical engagement with the contact and also prevents the conductor from being pulled out of the barrel.

The inwardly curled portions of the tines functions as a spiral spring to maintain pressure against the conductor. This spring force on one side of the conductor is backed by the lance on the opposite side of the conductor. Thus the subject crimp barrel provides multiple engagement locations for each crimped on contact.

The present invention may be subject to many modifications and changes without departing from the spirit or essential characteristics thereof. The present embodiment should therefor be considered in all respects as being merely illustrative and not restrictive of the scope of the present invention.

What is claimed is:

1. An electrical contact crimp barrel for use with thick flat flexible cable, said crimp barrel comprising:

a substantially U-shaped cross section defined by a base web and a pair of integral spaced sidewalls, each sidewall having at least one aperture formed therein adjacent the base web, a lance struck from said base web adjacent each said aperture, said lance extending normal to both said base and the sidewalls and including a projection at the free end thereof extending at least partially into said adjacent aperture, each said sidewall having a transverse slot in the free edge thereof substantially aligned with the respective lance, whereby after crimping of said barrel onto a conductor of a flat flexible cable with the sidwalls straddling the conductor and bent inwardly towards each other and curled upon themselves to form a spring, the conductor is pinched between the curled sidewalls and the lances to follow a tortuous path and each said slot straddles a respective lance.

2. An electrical contact crimp barrel according to claim 1 wherein:

each said sidewall is profiled to form at least two tines, each said tine having a transverse slot in the free edge thereof and an aperture at the juncture of said web and sidewall aligned with said slot, and a lance struck from said base for each said aperture.

3. In combination with an electrical contact having any matable configuration, an improved crimp barrel for effecting termination with thick flat flexible cable having a plurality of high current flat conductors encased within layers of insulative material, said crimp barrel comprising:

a base web and a pair of upstanding, integral, spaced sidewalls defining a substantially U-shaped section, at least one aperture in each said sidewall at its juncture with said base, a lance struck from said base web adjacent each said aperture, each said lance extending substantially normal to said base web and said sidewalls with a portion of said lance at the free end thereof projecting at least partially into the adjacent aperture, a transverse slot in the free edge of each said sidewall in substantial alignment with the respective lance, whereby said lances prevent collapse of said sidewalls during penetration of said cable insulation and act against the spring force of said sidewalls, which are subsequently curled inwardly upon themselves, to pinch the conductor therebetween forming a tortuous path for said conductor, each said lance lying within the respective slot.

4. The combination according to claim 3 wherein each said sidewall is profiled to form at least two tines, each tine having a slot and an aperture, and a lance formed in said base for each said aperture.

5. A crimp barrel for terminating thick flat flexible cable with an electrical contact, said crimp barrel comprising:

a base web and a pair of integral spaced sidewalls defining a substantially U-shaped section, each sidewall having at least one aperture formed therein adjacent the juncture with the base web, a lance struck from said base web adjacent each said aperture, each said lance extending normal to said base and said sidewalls and having a portion at the free end thereof projecting into said aperture, whereby said sidewalls pierce the insulation of a flat flexible cable in a first direction with the sidewalls straddling a conductor and prevented from premature collapse by said lances and said sidewalls are subsequently bent inwardly towards each other and curled upon themselves to form a spring and pierce said insulation from the opposite direction, said lances piercing the insulation from said first direction with the conductor being pinched between the curled sidewalls and the lances into a tortuous path.

6. A crimp barrel according to claim 5 wherein each said sidewall is profiled to define at least one tine, a slot in the free edge of each tine and an aperture at the juncture of each tine and said base web, and a lance formed in said base web for each said aperture.

* * * * *